US007388053B2

(12) United States Patent
Sullivan et al.

(10) Patent No.: US 7,388,053 B2
(45) **Date of Patent: *Jun. 17, 2008**

(54) PERIMETER WEIGHTED GOLF BALL

(75) Inventors: Michael J Sullivan, Barrington, RI (US); Derek A Ladd, Fairhaven, MA (US); Peter R. Voorheis, Fall River, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/256,544

(22) Filed: Oct. 21, 2005

(65) Prior Publication Data

US 2006/0035725 A1 Feb. 16, 2006

Related U.S. Application Data

(63) Continuation of application No. 10/208,580, filed on Jul. 30, 2002, now Pat. No. 6,991,563, and a continuation-in-part of application No. 10/164,809, filed on Jun. 7, 2002, now Pat. No. 6,774,187, which is a continuation-in-part of application No. 09/815,753, filed on Mar. 23, 2001, now Pat. No. 6,494,795.

(51) Int. Cl.
*A63B 37/00* (2006.01)
*A63B 37/06* (2006.01)

(52) U.S. Cl. ..... 525/274; 473/373; 473/374; 473/376

(58) Field of Classification Search ..... None
See application file for complete search history.

(56) References Cited

U.S. PATENT DOCUMENTS

| | | | | |
|---|---|---|---|---|
| 4,625,964 | A | 12/1986 | Yamada | |
| 4,863,167 | A | 9/1989 | Matsuki et al. | |
| 5,002,281 | A | 3/1991 | Nakahara et al. | |
| 5,048,838 | A | 9/1991 | Chikaraishi et al. | |
| 5,072,944 | A | 12/1991 | Nakahara et al. | |
| 5,104,126 | A | 4/1992 | Gentiluomo | |
| 5,184,828 | A | 2/1993 | Kim et al. | |
| 5,482,285 | A | 1/1996 | Yabuki et al. | |
| 5,490,674 | A | 2/1996 | Hamada et al. | |
| 5,553,852 | A | 9/1996 | Higuchi et al. | |
| 5,556,098 | A | 9/1996 | Higuchi et al. | |
| 5,702,311 | A | 12/1997 | Higuchi et al. | |
| 5,730,664 | A | 3/1998 | Asakura et al. | |
| 5,779,562 | A | 7/1998 | Melvin et al. | |
| 5,779,563 | A | 7/1998 | Yamagishi et al. | |
| 5,780,169 | A | 7/1998 | Hiraoka et al. | |
| 5,783,293 | A | 7/1998 | Lammi | |
| 5,810,678 | A | 9/1998 | Cavallaro et al. | |
| 5,830,085 | A | 11/1998 | Higuchi et al. | |
| 5,830,086 | A * | 11/1998 | Hayashi et al. | 473/376 |
| 5,876,294 | A | 3/1999 | Yamagishi et al. | |
| 5,879,244 | A | 3/1999 | Hwang | |
| 6,010,412 | A | 1/2000 | Moriyama | |
| 6,045,460 | A | 4/2000 | Hayashi et al. | |
| 6,068,561 | A | 5/2000 | Renard et al. | |
| 6,071,201 | A | 6/2000 | Maruko | |
| 6,120,393 | A | 9/2000 | Sullivan et al. | |
| 6,129,640 | A | 10/2000 | Higuchi et al. | |
| 6,135,898 | A | 10/2000 | Higuchi et al. | |
| 6,142,887 | A | 11/2000 | Sullivan et al. | |
| 6,194,505 | B1 | 2/2001 | Sone et al. | |
| 6,277,034 | B1 | 8/2001 | Nesbitt et al. | |
| 6,277,924 | B1 | 8/2001 | Hamada et al. | |
| 6,315,682 | B1 | 11/2001 | Iwami et al. | |
| 6,562,912 | B1 | 5/2003 | Sullivan et al. | |
| 6,685,580 | B2 | 2/2004 | Sullivan | |
| 6,790,148 | B1 * | 9/2004 | Yoshida et al. | 473/374 |
| 6,991,563 | B2 * | 1/2006 | Sullivan et al. | 473/374 |
| 2002/0034989 | A1 | 3/2002 | Sullivan et al. | |
| 2003/0073513 | A1 * | 4/2003 | Sakagami et al. | 473/367 |
| 2003/0229183 | A1 | 12/2003 | Voorheis et al. | |

OTHER PUBLICATIONS

Encyclopedia of Polymer Science and Engineering vol. 6; p. 522-524; 1987.*

* cited by examiner

*Primary Examiner*—David Buttner
(74) *Attorney, Agent, or Firm*—Kristin D. Wheeler

(57) ABSTRACT

A perimeter weighted golf ball with a low compression core is provided. The core preferably comprises a diene polymer that has low cross-link density or not cross-linked with a reactive co-agent. This core has low compression and low specific gravity. The low specific gravity core is encased within a thin dense layer positioned outside of the centroid radius to provide the ball with a high moment of inertia. The same core can be encased within a plurality of intermediate layers having either increasing hardness or decreasing hardness to provide selective golf balls for either low swing speed players or advanced players. Alternatively, a thin layer of diene polymer highly cross-linked with reactive a co-agent may be incorporated into the ball to increase the hardness of the ball.

11 Claims, 1 Drawing Sheet

PERIMETER WEIGHTED GOLF BALL

STATEMENT OF RELATED APPLICATION

This patent application is a continuation of U.S. patent application Ser. No. 10/208,580 entitled "Perimeter Weighted Golf Ball" and filed on Jul. 30, 2002 and issued as U.S. Pat. No. 6,991,563, which is a continuation-in-part of U.S. patent application bearing Ser. No. 09/815,753, which was filed on Mar. 23, 2001 and issued as U.S. Pat. No. 6,494,795, and a continuation-in-part of U.S. patent application bearing Ser. No. 10/164,809, which was filed on Jun. 7, 2002 and issued as U.S. Pat. No. 6,774,187. The parent applications are incorporated herein by reference in their entireties.

FIELD OF THE INVENTION

The present invention relates to golf balls and more particularly, the invention is directed to a perimeter weighted golf ball.

BACKGROUND OF THE INVENTION

The spin rate of golf balls is the end result of many variables, one of which is the distribution of the density or specific gravity within the ball. Spin rate is an important characteristic of golf balls for both skilled and recreational golfers. High spin rate allows the more skilled players, such as PGA professionals and low handicapped players, to maximize control of the golf ball. A high spin rate golf ball is advantageous for an approach shot to the green. The ability to produce and control back spin to stop the ball on the green and side spin to draw or fade the ball substantially improves the player's control over the ball. Hence, the more skilled players generally prefer a golf ball that exhibits high spin rate.

On the other hand, recreational players who cannot intentionally control the spin of the ball generally do not prefer a high spin rate golf ball. For these players, slicing and hooking are the more immediate obstacles. When a club head strikes a ball, an unintentional side spin is often imparted to the ball, which sends the ball off its intended course. The side spin reduces the player's control over the ball, as well as the distance the ball will travel. A golf ball that spins less tends not to drift off-line erratically if the shot is not hit squarely off the club face. The low spin ball will not cure the hook or the slice, but will reduce the adverse effects of the side spin. Hence, recreational players prefer a golf ball that exhibits low spin rate.

Reallocating the density or specific gravity of the various layers or mantles in the ball is an important means of controlling the spin rate of golf balls. In some instances, the weight from the outer portions of the ball is redistributed to the center of the ball to decrease the moment of inertia thereby increasing the spin rate. For example, U.S. Pat. No. 4,625,964 discloses a golf ball with a reduced moment of inertia having a core with specific gravity of at least 1.50 and a diameter of less than 32 mm and an intermediate layer of lower specific gravity between the core and the cover. U.S. Pat. No. 5,104,126 discloses a ball with a dense inner core having a specific gravity of at least 1.25 encapsulated by a lower density syntactic foam composition. U.S. Pat. No. 5,048,838 discloses another golf ball with a dense inner core having a diameter in the range of 15-25 mm with a specific gravity of 1.2 to 4.0 and an outer layer with a specific gravity of 0.1 to 3.0 less than the specific gravity of the inner core.

U.S. Pat. No. 5,482,285 discloses another golf ball with reduced moment of inertia by reducing the specific gravity of an outer core to 0.2 to 1.0.

In other instances, the weight from the inner portion of the ball is redistributed outward to increase the moment of inertia thereby decreasing the spin rate. U.S. Pat. No. 6,120,393 discloses a golf ball with a hollow inner core with one or more resilient outer layers, thereby giving the ball a soft core, and a hard cover. U.S. Pat. No. 6,142,887 discloses a high moment of inertia golf ball comprising one or more mantle layers made from metals, ceramic or composite materials, and a polymeric spherical substrate disposed inwardly from the mantle layers. U.S. Pat. No. 705,359 discloses a golf ball having a perforated metal shell positioned immediately interior to the outer cover. U.S. Pat. No. 5,984,806 discloses perimeter weighted golf ball, wherein the weights are visible on the surface of the golf ball. On the other hand, the weight of the ball can also be distributed outward by using a hollow, cellular or other low specific gravity core materials, as disclosed in U.S. Pat. Nos. 6,193,618 B1 and 5,823,889, among others.

These and other references disclose specific examples of high and low spin rate balls, but none of these references utilizes the selective variation of the ball's moment of inertia in combination with non-conventional core materials to create a high moment of inertia, low spin golf ball with improved feel characteristics.

SUMMARY OF THE INVENTION

The present invention is directed to a golf ball having a core that has a low cross-link density or a core that is not cross-linked with a reactive co-agent.

The present invention is also directed to a golf ball having a core that is cross-linked with a cross-linking initiator and is substantially free of a reactive co-agent.

The present invention is also directed to a perimeter weighted golf ball having a core that has a low cross-link density or a core that is not cross-linked with a reactive co-agent.

The present invention is also directed to a golf ball having a core that has a low cross-link density or a core that is not cross-linked with a reactive co-agent, encased by a plurality of intermediate layers.

The present invention is also directed to a golf ball having a core that has a low cross-link density or a core that is not cross-linked with a reactive co-agent, encased by a plurality of intermediate layers having increasing hardness.

The present invention is also directed to a golf ball having a core that has a low cross-link density or a core that is not cross-linked with a reactive co-agent, encased by a plurality of intermediate layers having decreasing hardness.

The present invention is also directed to a golf ball having a thin highly cross-linked layer of diene polymer may be incorporated into the ball to increase the hardness of the ball.

The present invention is also directed to a golf ball comprising a thin dense layer encasing a core and the thin dense layer is encased by a cover, wherein the thin dense layer has an inner diameter of at least 38.4 mm and a specific gravity of greater than 1.2 and a thickness from about 0.025 mm to 1.27 mm, and the thin dense layer is positioned at a radial distance outside of the centroid radius, and wherein the core comprises a core layer comprising an elastomeric composition, less than about 10 phr of a reactive co-agent and a cross-linking agent. Preferably the core layer comprises less than about 5 phr of the reactive co-agent and more preferably about 0 phr of the reactive co-agent.

In accordance to another aspect, the present invention is directed to a golf ball comprising a core encased at least by a first intermediate layer and a cover, wherein the core comprises at least a core layer comprising an elastomeric composition, less than about 10 phr of a reactive co-agent and a cross-linking agent, and wherein the core has a Shore C hardness of about 70 or less and the first intermediate layer has a Shore C hardness of about 70 to about 75 and the cover has a Shore C hardness of about 60 or less. Preferably the core layer comprises less than about 5 phr of the reactive co-agent and more preferably about 0 phr of the reactive co-agent. The golf ball may further comprise a second intermediate layer, which is harder than the first intermediate layer, and has a Shore C hardness of about 72 to about 77. The golf ball may also comprise a third intermediate layer, which is harder than the second intermediate layer, and has a Shore C hardness of about 75 to about 80.

In accordance to another aspect, the present invention is directed to a golf ball comprising a core encased at least by a first intermediate layer and a cover, wherein the core comprises at least a core layer comprising an elastomeric composition, less than about 10 phr of a reactive co-agent and a cross-linking agent, and wherein the core has a Shore C hardness of about 75 or higher and the first intermediate layer has a Shore C hardness of about 75 to about 72 and the cover has a Shore C hardness of about 70 or higher. Preferably the core layer comprises less than about 5 phr of the reactive co-agent and more preferably about 0 phr of the reactive co-agent. The golf ball may further comprise a second intermediate layer, which is softer than the first intermediate layer, and has a Shore C hardness of about 73 to about 70. The golf ball may also comprise a third intermediate layer, which is softer than the second intermediate layer, and has a Shore C hardness of less than about 70.

The reactive co-agent in the core layer comprises a metal salt of metal salt of diacrylate, dimethacrylate or monomethacrylate. In other words, the reactive co-agent comprises a metal salt of a mixture of a material selected from the group consisting of mono(meth)acrylic acid, di(meth)acrylic acid and mixtures thereof. The reactive co-agent may also be a non-metallic oligomer. The elastomeric composition in the core layer may be a diene polymer or metallocene-catalyzed polymer.

In accordance to another aspect, the present invention is directed to a golf ball comprising a thin layer encasing a core and the thin layer is encased by a cover, wherein the thin layer comprises a diene polymer cross-linked with at least about 50 phr of a reactive co-agent, wherein the thin layer has a thickness of about 0.025 mm to about 1.27 mm. The thin layer is preferably located outside of the centroid radius, and may comprise a cross-linking initiator.

In accordance to another aspect, the present invention is directed to a golf ball comprising an intermediate layer encasing a core and the intermediate layer is encased by a cover, wherein the core comprises an elastomeric composition, less than about 10 phr of a reactive co-agent and a cross-linking agent and the intermediate layer comprises a thermoplastic polymer. Preferably the core comprises less than about 5 phr of the reactive co-agent and more preferably about 0 phr of the reactive co-agent.

BRIEF DESCRIPTION OF THE DRAWINGS

In the accompanying drawings which form a part of the specification and are to be read in conjunction therewith and in which like reference numerals are used to indicate like parts.

DETAILED DESCRIPTION OF THE INVENTION

Figure 1:
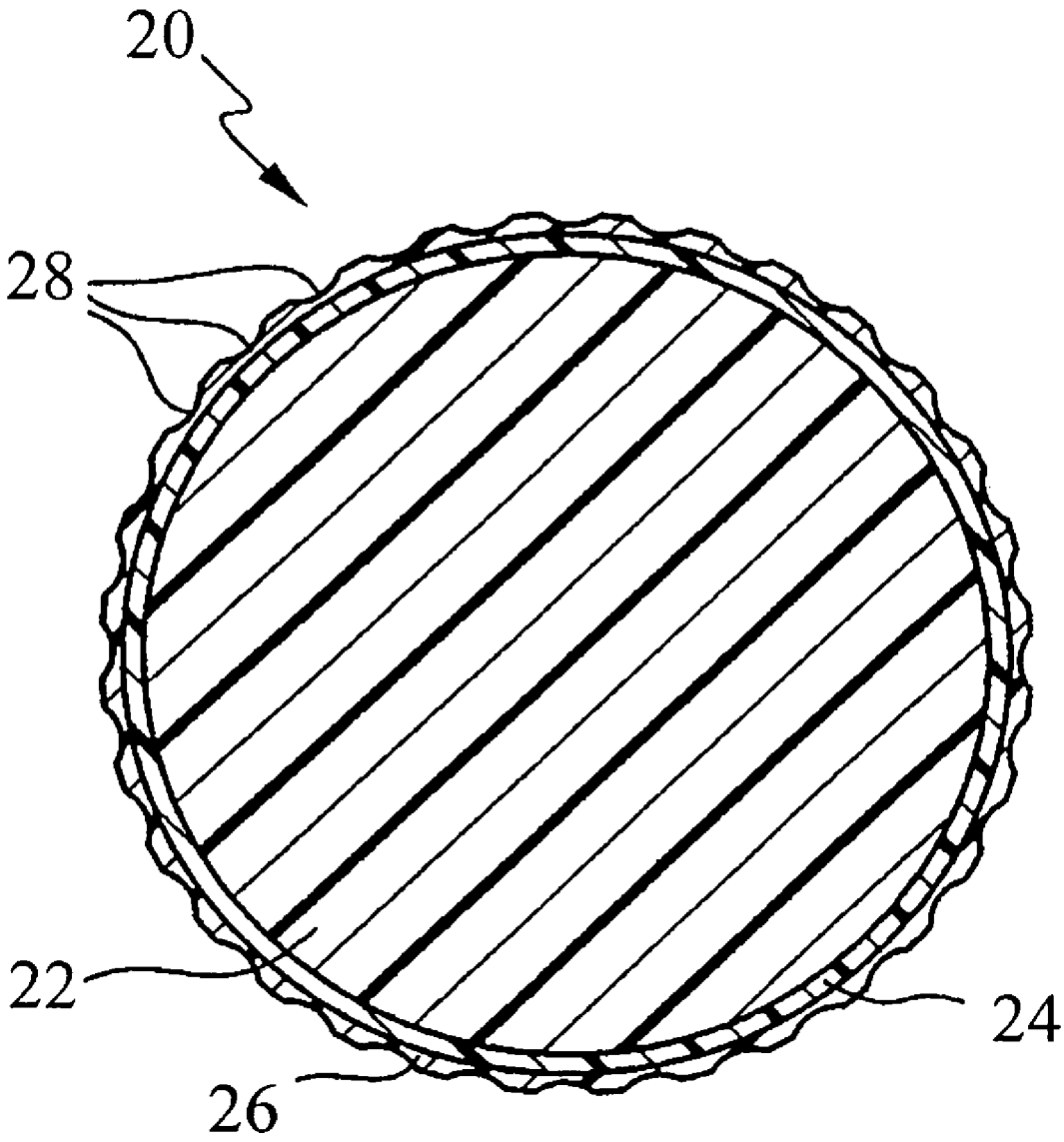
FIG. 1 is a cross-sectional view of a golf ball 20 having core 22, at least one intermediate layer 24 and an outer cover 26 with dimples 28 in accordance to the present invention.

Referring generally to FIG. 1 where golf ball 20 is shown, it is well known that the total weight of the ball has to conform to the weight limit set by the United States Golf Association ("USGA"). Distributing the weight or mass of the ball either toward the center of the ball or toward the outer surface of the ball changes the dynamic characteristics of the ball at impact and in flight. Specifically, if the density is shifted or distributed toward the center of the ball, the moment of inertia is reduced, and the initial spin rate of the ball as it leaves the golf club would increase due to lower resistance from the ball's moment of inertia. Conversely, if the density is shifted or distributed toward the outer cover, the moment of inertia is increased, and the initial spin rate of the ball as it leaves the golf club would decrease due to the higher resistance from the ball's moment of inertia. The radial distance from the center of the ball or from the outer cover, where moment of inertia switches from being increased and to being decreased as a result of the redistribution of weight or mass density, is an important factor in golf ball design.

In accordance to one aspect of the present invention, this radial distance, hereinafter referred to as the centroid radius, is provided. When more of the ball's mass or weight is reallocated to the volume of the ball from the center to the centroid radius, the moment of inertia is decreased, thereby producing a high spin ball. Hereafter, such a ball is referred as a low moment of inertia ball. When more of the ball's mass or weight is reallocated to the volume between the centroid radius and the outer cover, the moment of inertia is increased thereby producing a low spin ball. Hereafter, such a ball is referred as a high moment of inertia ball. The determination of the centroid radius is fully disclosed in the parent patent application Ser. No. 09/815,753, which has been incorporated by reference in its entirety. As disclosed fully in the parent application, the centroid radius is located at the same radial distance, i.e., at approximately 0.65 inch (16.51 mm) radially from the center of a ball weighing 1.62 oz and with a diameter of 1.68 inches (42.67 mm) or 0.19 inch (4.83 mm) from the outer surface of the ball.

Ball 20, as shown in FIG. 1, has an inner core 22 at least one intermediate layer 24 and a cover 26 with a plurality of dimples 28 defined thereon. Core 22 many comprise one or more core layers. Intermediate layer 24 may be a part of the core or a part of the cover, and may comprise one or more sub-layers.

More specifically, ball 20 is a high moment of inertia ball comprising a low specific gravity core 22, encased by a high specific gravity intermediate layer 24. At least a portion of core 22 is made with a low specific gravity, relatively soft thermoset or thermoplastic polymer that has low cross-link density such that the compression of the core is relatively low, as described below. As used herein, cross-link density is the number of cross-links per chain of molecule of polymer, and hence the molecular weight between cross-links. Cross-link density is typically measured by solvent swelling measurements in accordance to ASTM-D2765-95, method C utilizing a gravimetric method. Cross-link density may also be calculated by using a laser micrometer to measure the swell ratio of the polymer immersed in a solvent and then heated, in accordance to a method developed by the Cambridge Polymer Group, Inc. located in Somerville, Mass. The high specific gravity layer 24 is preferably positioned radially outward relative to the centroid radius to increase the moment of inertia. Ball 20, therefore, advantageously has a high moment of rotational inertia and low initial spin rates to reduce slicing and hooking when hit with a driver club and due to the softness of the core also provide good feel when struck with a club.

The term specific gravity, as used herein, has its ordinary and customary meaning, i.e., the ratio of the density of a substance to the density of water at 4° C., and the density of water at this temperature is 1 g/cm$^3$. Also, compression is measured by applying a spring-loaded force to the golf ball center, golf ball core or the golf ball to be examined, with a manual instrument (an "Atti gauge") manufactured by the Atti Engineering Company of Union City, N.J. This machine, equipped with a Federal Dial Gauge, Model D81-C, employs a calibrated spring under a known load. The sphere to be tested is forced a distance of 0.2 inch (5.08 mm) against this spring. If the spring, in turn, compresses 0.2 inch, the compression is rated at 100; if the spring compresses 0.1 inch (2.54 mm), the compression value is rated as 0. Thus more compressible, softer materials will have lower Atti gauge values than harder, less compressible materials. Compression measured with this instrument is also referred to as PGA compression. The approximate relationship that exists between Atti or PGA compression and Riehle compression can be expressed as:

(Atti or PGA compression)=(160−Riehle Compression).

Thus, a Riehle compression of 100 would be equated with an Atti or PGA compression of 60.

In accordance to one aspect of the invention, core 22 comprises at least a layer of elastomer, such as a diene polymer, that is cross-linked with low levels of a reactive co-agent, such as metal salt of diacrylate, dimethacrylate or monomethacrylate, preferably zinc diacrylate (ZDA), or alternatively with no reactive co-agent. Suitable metal salts include zinc, magnesium, calcium, barium, tin, aluminum, lithium, sodium, potassium, iron, zirconium, and bismuth, among others. Preferably, the elastomer is cross-linked with a cross-linking initiator, such as peroxide or sulfur. As used herein, a diene is a molecule, which contains two carbon-carbon double bonds, and a diene polymer is a polymer made from monomers, which have two carbon-carbon double bonds in the 1 and 3 positions. Suitable diene polymers include, but are not limited to, any polymers comprising natural rubbers, including cis-polyisoprene, trans-polyisoprene or balata, synthetic rubbers including 1,2-polybutadiene, cis-polybutadiene, trans-polybutadiene, polychloroprene, poly(norbornene), polyoctenamer and polypentenamer among other diene polymers.

Other suitable diene polymeric materials, which can be cross-linked with low levels of metal salt diacrylate, dimethacrylate or monomethacrylate reactive co-agent or none at all, further include metallocene catalyzed diene polymers, copolymers and terpolymers such as metallocene catalyzed polybutadiene, ethylene propylene rubber, ethylene-propylene-diene monomer terpolymers (EPDM), butadiene-styrene polymers, isoprene, copolymers with functionalized monomers (polar groups), among others. As used herein, the term "metallocene catalyzed" includes polymerization catalyzed by metallocenes, which generally consist of a positively charged metal ion sandwiched between two negatively charged cyclopentadienyl anions, and other single-site catalysts. Additionally, suitable elastomeric core materials also include the metallocene catalyzed polymers disclosed in U.S. Pat. Nos. 5,981,658, 5,824,746, 5,703,166, 6,126,559, 6,228,940, 6,241,626 and 6,414,082. Metallocene catalyzed polymers can be cross-linked with a cross-linking initiator, such as peroxide, or can be cross-linked by radiation, among other techniques. Additional suitable core materials include poly(styrene-butadiene-styrene) or SBS rubber, SEBS or SEPS block polymers, styrene-ethylene block copolymers, any polar group grafted or copolymerized polymers such as maleic anhydride or succinate modified metallocene catalyzed ethylene copolymer or blends thereof.

Thermoplastic elastomers, such as ionic or non-ionic polyester, polyether, polyamide may also be present in amounts of less than 50% of the polymeric content of the core may be included to adjust or modify any physical property or manufacturing characteristics. Furthermore, any organo-sulfur or metal-organo-sulfur compound, such as zinc pentachlorothiophenol (ZnPCTP) or pentachlorothiophenol (PCTP), to increase CoR or rigidifying agents, such as those disclosed in U.S. Pat. Nos. 6,162,135, 6,180,040, 6,180,722, 6,284,840, 6,291,592 and 6,339,119 and those disclosed in co-pending U.S. application Ser. No. 09/951,963 entitled "Golf ball Cores Comprising a Halogenated Organo Sulfur Compound" filed on Sep. 13, 2001, may be added.

A first exemplary core composition comprises about 100 parts of a cis-polybutadiene or trans-polybutadiene, about 5 phr zinc oxide or higher, about 0.5-5 phr peroxide cross-linking initiator and an optional about 1-25 phr zinc stearate. More preferably, the zinc oxide component is 10 phr or higher. As used herein "phr" means parts per hundred parts of rubber. The peroxide cross-linking initiator provides a certain amount of cross-linking for the polybutadiene to provide the composition with some structure. Advantageously, since the cross-linking is minimal the composition is soft, and provides good feel when a club strikes the ball. The peroxide may be omitted from this composition so that the diene polymer is not cross-linked. A reactive co-agent, such as ZDA may be present in an amount of less than 10 phr or more preferably between 0 phr and about 5 phr. Additionally, since polybutadiene is the dominant ingredient in the composition the specific gravity of this composition is close to that of polybutadiene, which is about 0.91. A ball comprising this core composition inherently has a high moment of inertia when outer layer(s) are made with sufficiently high specific gravity to produce a ball meeting the U.S.G.A. weight limit.

A second exemplary core composition comprises about 100 parts of a high ethylene content metallocene catalyzed or other single-site catalyzed EPDM terpolymer, about 5 phr of zinc oxide, about 1 phr stearic acid, about 2 phr zinc dithiobutyldithiocarbamate, about 0.5 phr tetramethylthiuram and about 1.5 phr sulfur cross-linking initiator. The preferred metallocene catalyzed EPDM comprises from about 70% to about 90% by weight of ethylene and 1-5% ethylidene-2-norborene, and has a Mooney viscosity of about 20 to about 40, and a specific gravity of about 0.87 to 0.93. The sulfur cross-linking initiator component provides a certain amount of cross-linking for the EPDM. Similar to the first exemplary core composition, the second composition has a minimal amount of cross-linking to provide the soft feel, and since the EPDM is the dominant ingredient the specific gravity of the composition is close to that of EPDM to provide a high moment of inertia ball. A reactive co-agent, such as ZDA may be present in an amount of less than 10 phr or more preferably between 0 phr and about 5 phr. The sulfur component may be omitted so that the diene polymer is not cross-linked.

As used herein, a "Mooney" unit is a unit used to measure the plasticity of raw or unvulcanized rubber. The plasticity in a "Mooney" unit is equal to the torque, measured on an arbitrary scale, on a disk in a vessel that contains rubber at a temperature of 100° C. and rotates at two revolutions per minute. The measurement of Mooney viscosity is defined according to ASTM D-1646.

In a first preferred embodiment of the core of the present invention, core 22 comprises either the first or second exemplary core composition and has a diameter of up to 1.62 inches (41.15 mm) with a compression in the range of about 0-70 Atti, and more preferably in the range of 10-60 Atti, and a specific gravity of less than 1.05. The coefficient of restitution (CoR) of such core is at least 0.600 and is typically 0.700 or higher. When core 22 is encased in other layers, such as thin dense layer(s), other intermediate layer (s) and cover layer(s), the coefficient of the entire ball assembly is at least 0.800, while the low compression, low specific gravity core further provides the ball with a soft feel and high moment of inertia.

In a second preferred embodiment of the core of the present invention, core 22 comprises a stiff, highly cross-linked inner core encased by an outer core layer comprising either the first or second exemplary core composition. The inner core preferably comprises 100 parts cis-polybutadiene or trans-polybutadiene cross-linked with about 10 to 50 phr ZDA reactive co-agent. Preferably, the inner core has a diameter in the range of about 0.100 inch to about 1.60 inch (about 2.54 mm to about 40.64 mm), and the outer core layer has a thickness of about 0.010 inch to about 0.100 inch (about 0.25 mm to about 2.54 mm). Alternatively, the inner core may comprise a higher cross-linked density material to provide a higher flexural modulus to increase the CoR for core 22 and to reduce driver spin rate. Such higher cross-linked density material may contain about 100 parts polymer such as polybutadiene, greater than 50 phr of ZDA or other metal salt of diacrylate, dimethacrylate or monomethacrylate reactive co-agent, about 0.1 to 6.0 phr of peroxide cross-linking initiator, a heavy filler and an optional organic sulfur such as ZnPCPT.

Examples of the second embodiment of core 22 were made with a highly cross-linked inner core encased by an outer core layer comprising the first exemplary core composition. These Examples, labeled as A-C below, were compared to the same inner core encased by a blend of ionomers, such as Surlyn® available from Du Pont. In all the Examples A-C and Comparative A, the inner core has a diameter of about 1.550 inches and is made out of polybutadiene cross-linked with about 29 phr ZDA reactive co-agent. The inner core has a compression of 73, a CoR of 0.800 and a hardness of 44 Shore D. In Examples A, B, C and Comparative A, the outer core has a thickness of about 0.035 inch.

In Example A, the outer core layer comprises 100 parts polybutadiene, 3.3 phr peroxide cross-linking initiator (Varox 802-40KE-HP) and 31 phr zinc oxide. In Example B, the outer core comprises 100 parts polybutadiene, 0.83 phr peroxide (Varox 802-40KE-HP), 31 phr zinc oxide and 3.5 phr of siliconized urethane acrylate oligomer (Sartomer CN990). The siliconized urethane acrylate oligomer functions as a non-metallic reactive co-agent in this formulation. This oligomer typically has lower molecular weight than a polymer, and is typically less reactive than ZDA. In Example C, the outer core comprises 100 parts polybutadiene, 0.83 phr peroxide (Varox 802-40KE-HP), 31 phr zinc oxide and 4 phr ZDA reactive co-agent. The properties of the Examples A-C are as follows:

| | Inner Core | Comparative A | Example A | Example B | Example C |
|---|---|---|---|---|---|
| Compression (Atti) | 73 | 81 | 71 | 67 | 70 |
| CoR | 0.800 | 0.806 | 0.798 | 0.799 | 0.803 |
| Shore D Hardness | 44 | 61 | 35 | 34 | 32 |

In all the Examples, outer core layers made in accordance to the first embodiment of core 22 of this invention resulted in a softer ball, which advantageously provide more feel for the golfer without appreciable loss of CoR. On the other hand, Comparative A with an ionomer blend outer core layer is a harder core with relatively high compression and hardness.

In accordance to a first embodiment of the core/intermediate layer(s) assembly of the present invention, core 22, e.g., those shown as Examples A-C above, is preferably encased in a thin dense layer 24, such as the thin dense layer disclosed in the parent application Ser. No. 09/815,753, which has been incorporated by reference in its entirety, and is further described below.

Preferably, thin dense layer 24 is located proximate to outer cover 26, and preferably layer 24 is made as thin as possible. Layer 24 may have a thickness from about 0.001 inch to 0.05 inch (0.025 mm to 1.27 mm), more preferably from about 0.005 inch to 0.030 inch (0.127 mm to 0.76 mm), and most preferably from about 0.010 inch to 0.020 inch (0.25 mm to 0.5 mm). Thin dense layer 24 preferably has a specific gravity of greater than 1.2, more preferably more than 1.5, even more preferably more than 1.8 and most preferably more than 2.0. Preferably, thin dense layer 24 is located as close as possible to the outer surface of ball 20, i.e., the land surface or the un-dimpled surface of cover 26. For golf ball having a cover thickness of 0.030 inch (0.76 mm), the thin dense layer would be located from 0.031 to 0.070 inch (0.79 mm to 1.78 mm) from the land surface including the thickness of the thin dense layer, well outside the centroid radius discussed above. For a golf ball having a cover thickness (one or more layers of the same or different material) of 0.110 inch (2.8 mm), the thin dense layer would be located from about 0.111 to 0.151 inch (2.82 mm to 3.84 mm) from the land surface, also outside the centroid radius. The advantages of locating the thin dense layer as radially outward as possible have been discussed in detail above. It is, however, necessary to locate the thin dense layer outside of the centroid radius.

Except for the moment of inertia and CoR, the presence of the thin dense layer preferably does not appreciably affect the overall ball properties, such as the feel, compression, and cover hardness. As discussed above, the weight of the ball from inside the centroid radius, i.e., the low specific gravity inner core 22, is low to keep the ball to the USGA weight and to produce a high moment of inertia golf ball.

Suitable materials for the thin dense layer include any material that meets the specific gravity and thickness conditions stated above. The thin dense layer is preferably applied to the inner core 22 as a liquid solution, dispersion, lacquer, paste, gel, melt, etc. such as a loaded or filled natural or non-natural rubber latex, polyurethane, polyurea, epoxy, polyester, any reactive or non-reactive coating or casting material, and then cured, dried or evaporated down to the equilibrium solids level. The thin dense layer may also be formed by compression or injection molding, RIM, casting, spraying, dipping, powder coating, or any means of depositing materials onto the inner core. The thin dense layer may also be a thermoplastic polymer loaded with a specific gravity increasing filler, fiber, flake or particulate, such that it can be applied as a thin coating and meets the preferred specific gravity levels discussed above. One particular example of a thin dense layer, which was made from a soft polybutadiene with tungsten powder using the compression molded method, has a thickness of 0.021-0.025 inch (0.53 mm-0.64 mm) and a specific gravity of 1.31 and a Shore C Hardness of about 72. Relevant to the present application, a Shore D hardness value is typically about 20 points lower than a Shore C hardness value for the same material.

For reactive liquid systems, the suitable materials include any material which reacts to form a solid such as epoxies, styrenated polyesters, polyurethanes or polyureas, liquid PBR's, silicones, silicate gels, agar gels, etc. Casting, RIM, dipping and spraying are the preferred methods of applying a reactive thin dense layer. Non-reactive materials include any combination of a polymer either in melt or flowable form, powder, dissolved or dispersed in a volatile solvent. Suitable thermoplastics are disclosed in U.S. Pat. Nos. 6,149,535 and 6,152,834.

Alternatively, a loaded thin film or "pre-preg" or a "densified loaded film," as described in U.S. Pat. No. 6,010,411 related to golf clubs, may be used as the thin film layer in a compression molded or otherwise in a laminated form applied inside the cover layer 26. The "pre-preg" disclosed in the '411 patent may be used with or without the fiber reinforcement, so long as the preferred specific gravity and preferred thickness levels are satisfied. The loaded film comprises a staged resin film that has a densifier or weighing agent, preferably copper, iron or tungsten powder evenly distributed therein. The resin may be partially cured such that the loaded film forms a malleable sheet that may be cut to desired size and then applied to the outside of the core or inside of the cover. Such films are available from the Cytec of Anaheim, Calif. or Bryte of San Jose, Calif.

As described above, inner core 22 preferably comprises the inventive first or second exemplary core composition. Inner core 22 is preferably a solid unitary or solid multi-piece core, and may also include a wound layer, a liquid, a gel, and a hollow or foamed layer. The core may also include one or more layers of polybutadiene encased in a layer or layers of polyurethane. If a liquid form of the thin dense layer 24 is deposited next to a wound layer of core 22, the liquid material may penetrate into the wound layer. U.S. Pat. No. 5,947,843 predicted that a prevulcanized latex material could penetrate to a depth of 0.050 inch (about 1.27 mm). However, the depth of penetration depends on factors such as the viscosity and temperature of the liquid and the spacing or other surface phenomenon of the wound layer. When the inner core 22 is a solid or non-wound core, the thin dense layer in liquid form may leave a film having a thickness of 0.001 inch (0.025 mm) or higher. The liquid material may be cured with ultraviolet waves or dried with heat or at ambient conditions. When the liquid is dried with heat, the inner core material is preferably made from a thermosetting material to avoid heat softening of the core. A preferred latex is a pre-vulcanized Heveatex model No. 1704, manufactured by Heveatex Corporation, Fall River, Mass. Also, other latex coated cores are disclosed in U.S. Pat. Nos. 5,989,136 and 6,030,296. U.S. Pat. No. 5,993,968 discloses a wound core impregnated with urethane dispersion (non-filled) prior to a thermoplastic material being injection molded over the core.

In accordance to a second embodiment of the core/intermediate layer(s) assembly of the present invention, core 22 is preferably encased in a plurality of intermediate layers, such as those described in co-pending patent application entitled "Multi-layered Core Golf Ball" bearing Ser. No. 10/002,641 filed on Nov. 28, 2001. The disclosure of this patent application is hereby incorporated by referenced in its entirety.

In this embodiment, the intermediate layer 24 comprises three sub-layers that are formed of a thermoset rubber, such as polybutadiene rubber or another diene polymer. While three sub-layers are illustrated below, it is understood that any number of sub-layers can be used. In this embodiment, the core's diameter should be greater than about 1 inch (25.4 mm) and, preferably, should be about 1.25 to about 1.60 inches (31.75 mm to 40.64 mm). A preferred core has a diameter of about 1.4 inches (35.56 mm). Each of the sub-layers surrounding the core should have a thickness of less than about 0.1 inch (2.54 mm) and preferably, less than about 0.05 inch (1.27 mm). The most preferred thickness of the sub-layers is about 0.03 to about 0.05 inch (0.76 mm to 1.27 mm) where the thickness of the third sub-layer is equal to or less than the thickness of the first and second sub-layers. Moreover, the core of the golf ball preferably has an outer diameter of greater than 60 percent of the finished ball's diameter. Preferably, the core has a diameter that is at least 75 percent of the diameter of the finished ball.

For a high spin rate ball that also has good driver trajectory characteristics, core 22 of the golf ball should have Shore C hardness of about 70 or less. The first encasing layer immediately adjacent to core 22 should be harder than the core and should have a Shore C hardness of about 70 to about 75. The second encasing sub-layer should be harder than the first sub-layer and have a Shore C hardness of about 72 to about 77. The third sub-layer or outer sub-layer should be harder than the second sub-layer and have a Shore C hardness of about 75 to about 80. The cover 26 should be a soft cover and have a Shore D of less than 60. The cover is described further below. Moreover, the core, three sub-layers and the cover should be configured to provide a golf ball compression of less than 85 and more preferably, less than about 80.

By creating a core 22 with relatively thin encasing sub-layers that are progressively harder, the spin rate of the ball is surprisingly good for a player who desires a high spin rate golf ball. More particularly, when this type of player hits the ball with a short iron, only the outer sub-layer and cover affect the spin rate of the ball. By incorporating a relatively hard outer sub-layer and a soft cover, the spin rate is maximized for the short iron shot such as a wedge having an angle of about 48 to 60 degrees. In order to reduce the spin rate a little for middle iron shots such as a 6 iron having aloft of about 32 degrees to make sure that sufficient distance is obtained, the second sub-layer is softer than the third sub-layer. Similarly, to decrease the spin rate, provide good distance and a good trajectory for long irons such as a 3 iron having a loft of about 20 degrees, the first sub-layer is softer than the second sub-layer. Finally, for a low spin rate with the driver having a loft of about 8 to 12 degrees, the core is made very soft.

The solid core in accordance to the present invention and the three sub-layers may have a total diameter as large as 1.66 inch (41.47 mm), and preferably about 1.58 inches (40.13 mm). The three sub-layers may be made using the compositions of the intermediate sub-layer materials described in co-pending application Ser. No. 10/002,641, which has been incorporated in its entirety. Such cores preferably have a compression of about 50. The first sub-layer composition preferably has a compression of about 75. Preferably, the first sub-layer material will have a compression that is over 25 percent greater than the compression of the core material. The second sub-layer composition preferably has a compression of about 85 and, thus, has a greater compression than the first sub-layer. The third sub-layer composition has a compression of about 110, which is significantly greater than the second sub-layer. Preferably, the third sub-layer compression is more than 75 percent greater than the core material compression.

In accordance to a third embodiment of the core/intermediate layer(s) assembly of the present invention, core 22 is preferably encased in a plurality of intermediate layers, such as those described in co-pending patent application bearing Ser. No. 10/002,641, which has already been incorporated by referenced in its entirety. However, converse to the second embodiment of the core/intermediate layer(s) assembly discussed above, the exemplary three sub-layers are progressively softer, i.e., lower Shore C hardness value. The dimensions of core 22 and the sub-layers are similar to those in the second embodiment of core/intermediate layer(s) assembly.

The core of this third embodiment should have a Shore C hardness of greater than about 75 for low swing speed players. The first sub-layer should be softer than the center and have a Shore C hardness of about 75 to 72. The second sub-layer should be softer than the first sub-layer and have a Shore C hardness of about 73 to 70. The third sub-layer should be the softest and have a Shore C hardness of less than about 70. The cover for this embodiment should have good resilience and durability, and has a Shore C hardness of about 70 or higher. Preferably, the cover is a harder cover and includes a blend of about 50/50 by weight of two standard or high acid ionomers. Standard ionomers have about 15 parts by weight of acrylic or methacrylic acid. High acid ionomers have about 17 or more parts by weight of acrylic or methacrylic acid.

By creating a golf ball core 22 with relatively thin outer sub-layers that progressively get softer, the feel and distance is optimized for a low swing speed player. More particularly, when the low swing speed player hits the ball with a short iron, only the outer or third sub-layer and cover are compressed. By utilizing a soft core and a harder cover, the feel of the ball is relatively soft when compared to distance balls having hard covers and hard cores. In order to increase the distance for middle irons while still providing a relatively soft feel, the second sub-layer is made harder than the third sub-layer. Similarly, to provide greater resiliency for long irons, the first sub-layer is harder than the second sub-layer. Finally, for maximum resiliency with the driver, the center is made harder than each of the sub-layers. Since the inner core 22 is relatively large, i.e., between about 1.25 and 1.60 inches (31.75 mm to 40.64 mm) in diameter, the ball has a high compression and initial velocity. However, since the third sub-layer is soft, the ball provides a surprisingly better feel than hard core/hard cover balls.

In accordance to another aspect of the invention, the thin dense layer of the first embodiment of the core/intermediate layer(s) assembly or one of the intermediate sub-layers of the second and third embodiments of the core/intermediate layer(s) assembly may comprise a highly cross-linked density material to provide a higher flexural modulus to increase the CoR and to lower driver spin rate. Such higher cross-linked density material may contain about 100 parts polymer such as polybutadiene, greater than 50 phr of ZDA or other metal salt diacrylate, dimethacrylate or monomethacrylate reactive co-agent, about 0.1 to 6.0 phr of peroxide, a heavy filler and an optional organic sulfur such as ZnPCPT.

As shown below, example D with an inner conventional core having a diameter of about 1.510 inch is encased within an outer core layer of about 0.040 inch thick, wherein the outer core layer comprises about 66 phr of ZDA. Example D is compared to Comparative B, which has a similar inner core and an outer core layer comprising about 36 phr of ZDA. The comparative test results are as follows:

| | Inner Core | Comparative B | Example D |
|---|---|---|---|
| Compression (Atti) | 57 | 61 | 65 |
| CoR | 0.826 | 0.827 | 0.830 |
| Shore D | 46 | 56 | 66 |

These results confirm that an outer core layer with greater than 50 phr of a reactive co-agent produces a core subassembly with higher CoR and hardness.

In accordance to a fourth embodiment of the core/intermediate layer(s) assembly of the present invention, core 22 made from either the first or second exemplary core composition described above is preferably encased in a layer of thermoplastic material, such as those described in U.S. Pat. Nos. 6,057,403 and 6,213,895. The disclosures of the '403 and '895 patents are incorporated herein by reference in their entireties. Thermoplastics have high durability, impact resistance and toughness, and may be processed by a variety of manufacturing techniques, such as injection molding, compression molding, thermo-forming, and laminating. Alternatively, core 22 made from either the first or second exemplary core composition can also be encased in a highly neutralized polymers, such as those disclosed in PCT publication nos. WO/0023519 and WO/0129129. These references are also incorporated herein by reference.

The cover layer 26 is preferably a resilient, non-reduced specific gravity layer. Preferably, the cover does not have a density-adjusting element, except for pigments, colorants, stabilizers and other additives employed for reasons other than adjusting the density of the cover. Suitable materials include any material that allows for tailoring of ball compression, coefficient of restitution, spin rate, etc. and are disclosed in U.S. Pat. Nos. 6,392,002, 6,210,294, 6,287,217, 6,152,834, 5,919,100 and 5,885,172. Partially or fully neutralized ionomers, ionomer blends, thermosetting or thermoplastic polyurethanes, metallocenes are the preferred materials. The cover can be manufactured by a casting method, reaction injection molded, injected or compression molded, sprayed or dipped method.

In accordance to another aspect of the present invention, it has been found that by creating a golf ball with a low spin construction, such as low specific gravity core 22 and high specific gravity intermediate layer 24 of ball 20 discussed above, but adding a cover 26 of a thin layer of a relatively soft thermoset material formed from a castable reactive liquid, a golf ball with "progressive performance" from driver to wedge can be formed. As used herein, the term "thermoset" material refers to an irreversible, solid polymer that is the product of the reaction of two or more prepolymer precursor materials.

The thickness of the outer cover layer is important to the performance of the golf balls of the present invention. If the outer cover layer is too thick, this cover layer will contribute to the in-flight characteristics related to the overall construction of the ball and not the cover surface properties. However, if the outer cover layer is too thin, it will not be durable enough to withstand repeated impacts by the golfer's clubs. It has been determined that the outer cover layer should have a thickness in the range of about 0.010 to about 0.100 inch (0.25 mm to 2.54 mm), preferably in the range of about 0.010 to about 0.050 inch (0.25 mm to 1.27 mm), more preferably between about 0.02 and about 0.04 inch (0.508 mm to 1.016 mm). Most preferably, this thickness is about 0.03 inch (0.762 mm).

The outer cover layer is formed from a relatively soft thermoset material in order to replicate the soft feel and high spin play characteristics of a balata ball when the balls of the present invention are used for pitch and other "short game" shots. In particular, the outer cover layer should have a Shore D hardness of less than 65 or from about 30 to about 60, preferably 35-50 and most preferably 40-45. Additionally, the materials of the outer cover layer must have a degree of abrasion resistance in order to be suitable for use as a golf ball cover. The outer cover layer of the present invention can comprise any suitable thermoset material which is formed from a castable reactive liquid material. The preferred materials for the outer cover layer include, but are not limited to, thermoset urethanes and polyurethanes, thermoset urethane ionomers and thermoset urethane epoxies. Examples of suitable polyurethane ionomers are disclosed in U.S. Pat. No. 5,692,974 entitled "Golf Ball Covers," the disclosure of which is hereby incorporated by reference in its entirety in the present application.

Thermoset polyurethanes and urethanes are particularly preferred for the outer cover layers of the balls of the present invention. Polyurethane is a product of a reaction between a polyurethane prepolymer and a curing agent. The polyurethane prepolymer is a product formed by a reaction between a polyol and a diisocyanate. The curing agent is typically either a diamine or glycol. Often a catalyst is employed to promote the reaction between the curing agent and the polyurethane prepolymer.

Conventionally, thermoset polyurethanes are prepared using a diisocyanate, such as 2,4-toluene diisocyanate (TDI) or methylenebis-(4-cyclohexyl isocyanate) (HMDI) and a polyol which is cured with a polyamine, such as methylenedianiline (MDA), or a trifunctional glycol, such as trimethylol propane, or tetrafunctional glycol, such as N,N,N',N'-tetrakis(2-hydroxpropyl)ethylenediamine. However, the present invention is not limited to just these specific types of thermoset polyurethanes. Quite to the contrary, any suitable thermoset polyurethane may be employed to form the outer cover layer of the present invention.

Alternatively, multiple-layer covers such as those described in U.S. Pat. Nos. 6,132,324 and 5,885,172 can be used. For example, a two-layer cover comprising an inner stiff resilient layer made from a high or low acid ionomer and an outer soft layer made from a thermoset polyurethane is a suitable cover layer.

While various descriptions of the present invention are described above, it is understood that the various features of the present invention can be used singly or in combination thereof. Therefore, this invention is not to be limited to the specifically preferred embodiments depicted therein.

What is claimed is:

1. A golf ball comprising a core, a thin layer having a thickness of about 0.025 mm to about 0.76 mm encasing the core, and a cover encasing the thin layer, wherein the thin layer comprises a diene polymer cross-linked with at least about 50 phr of a reactive co-agent and the thin layer has a specific gravity of greater than 1.8;

wherein an elastomeric composition is disposed in the core wherein the composition comprises one or more materials selected from a group consisting thermoset polymers, thermoplastic polymers, highly neutralized polymers, metallocene or single-site catalyst catalyzed polymers, polybutadienes, ethylene-propylene-diene polymers, poly(styrene-butadiene-styrene), SEBS, SEPS block polymers, styrene-ethylene block copolymers, diene polymers, and any polar group grafted or copolymerized polymers;

wherein the elastomeric composition further comprises greater than about 50 phr of a second different reactive co-agent.

2. The golf ball of claim 1, wherein the thickness of the thin layer is about 0.127 mm to about 0.76 mm.

3. The golf ball of claim 1, wherein the thickness of the thin layer is about 0.25 mm to about 0.5 mm.

4. The golf ball of claim 1, wherein the diene polymer comprises one or more polymers selected from a group consisting polybutadienes, ethylene-propylene-diene polymers, SEBS, and metallocene catalyst or single-site catalyst catalyzed diene polymers.

5. The golf ball of claim 1, wherein the reactive co-agent comprises one or more compounds selected from a group consisting non-metallic oligomers, bismuth, and metallic salts selected from zinc, magnesium, calcium, barium, tin, aluminum, lithium, sodium, potassium, iron, or zirconium salts of diacrylate, dimethacrylate, or monomethacrylate.

6. The golf ball of claim 1, wherein the thin layer further comprises sulfur or peroxide.

7. The golf ball of claim 1, wherein the core comprises an innermost core and one or more core layers.

8. The golf ball of claim 1, wherein the core has a diameter of less than about 41.15 mm.

9. The golf ball of claim 1, wherein the golf ball further comprises one, two, or three intermediate layers disposed between the core and the cover, each intermediate layer having a thickness of less than about 2.54 mm.

10. The golf ball of claim 1, wherein the thin layer is disposed outside a centroid radius of the golf ball.

11. The golf ball of claim 1, wherein the thin layer has an inner diameter of at least about 38.4 mm.

* * * * *